US011749945B2

(12) United States Patent
Hirai

(10) Patent No.: US 11,749,945 B2
(45) Date of Patent: Sep. 5, 2023

(54) MOVABLE CONNECTOR

(71) Applicant: SUMITOMO WIRING SYSTEMS, LTD., Mie (JP)

(72) Inventor: Kentaro Hirai, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/572,832

(22) Filed: Jan. 11, 2022

(65) Prior Publication Data

US 2022/0231456 A1 Jul. 21, 2022

(30) Foreign Application Priority Data

Jan. 21, 2021 (JP) ..... 2021-007867

(51) Int. Cl.
*H01R 13/629* (2006.01)

(52) U.S. Cl.
CPC . *H01R 13/62933* (2013.01); *H01R 13/62955* (2013.01); *H01R 13/62938* (2013.01)

(58) Field of Classification Search
CPC ..... H01R 13/62933; H01R 13/62955; H01R 13/62938
See application file for complete search history.

(56) References Cited

U.S. PATENT DOCUMENTS 7,476,116 B2 * 1/2009 Shinozaki ..... H01R 13/62938 439/345
8,784,127 B2 * 7/2014 Bashkin ..... H01R 13/62955 439/372

FOREIGN PATENT DOCUMENTS

| | | |
|---|---|---|
| JP | 2009-117045 A | 5/2009 |
| JP | 2011-034843 A | 2/2011 |
| WO | 2014/115363 A1 | 7/2014 |

* cited by examiner

*Primary Examiner* — Oscar C Jimenez
*Assistant Examiner* — Paul D Baillargeon
(74) *Attorney, Agent, or Firm* — Venjuris, P.C.

(57) ABSTRACT

A connector includes a first housing, a second housing connectable to the first housing, and a lever rotatably supported on the first housing. The lever includes a lever lock portion for holding the first and second housings in a connected state. The first housing includes a first locking portion and the second housing has a second locking portion. The first and second locking portions, are arranged side by side with each other to constitute an integrated locking portion and arranged to be lockable to the lever lock portion with the first and second housings connected.

5 Claims, 10 Drawing Sheets

MOVABLE CONNECTOR

CROSS-REFERENCE TO RELATED APPLICATIONS

This application is based on and claims priority from Japanese Patent Application No. 2021-007867, filed on Jan. 21, 2021, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2011-034843 includes a housing and a lever rotatably supported on the housing. The housing is connected to a mating connector as the lever is rotated. The housing includes a lock protrusion. The lever includes a deflectable and deformable lever lock portion. The lever lock portion is locked to the lock protrusion, whereby the housing is held in a state connected to the mating connector. A lever having such a lock is also disclosed in Japanese Patent Laid-open Publication No. 2009-117045 and International Publication Pamphlet No. WO 2014/115363.

SUMMARY

In the case of Japanese Patent Laid-open Publication No. 2011-034843, since the lever lock portion is locked only to the lock protrusion with the housing connected to the mating connector, a load is concentrated on the lock protrusion, which is not preferable. Thus, the lock protrusion needs to have strength to resist a load. If there is a request to enhance a holding force by the lever, the size (thickness or width) of the lock protrusion needs to be increased. However, if the size of the lock protrusion is increased, it affects a peripheral structure of the lock protrusion and the housing may be enlarged.

Accordingly, the present disclosure aims to provide a connector capable of enhancing a holding force by a lever.

The present disclosure is directed to a connector with a first housing, a second housing connectable to the first housing, and a lever rotatably supported on the first housing, wherein the lever includes a lever lock portion for holding the first and second housings in a connected state, the first housing includes a first locking portion and the second housing has a second locking portion, and the first and second locking portions are arranged side by side with each other to constitute an integrated locking portion and arranged to be lockable to the lever lock portion with the first and second housings connected.

According to the present disclosure, it is possible to provide a connector capable of enhancing a holding force by a lever.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
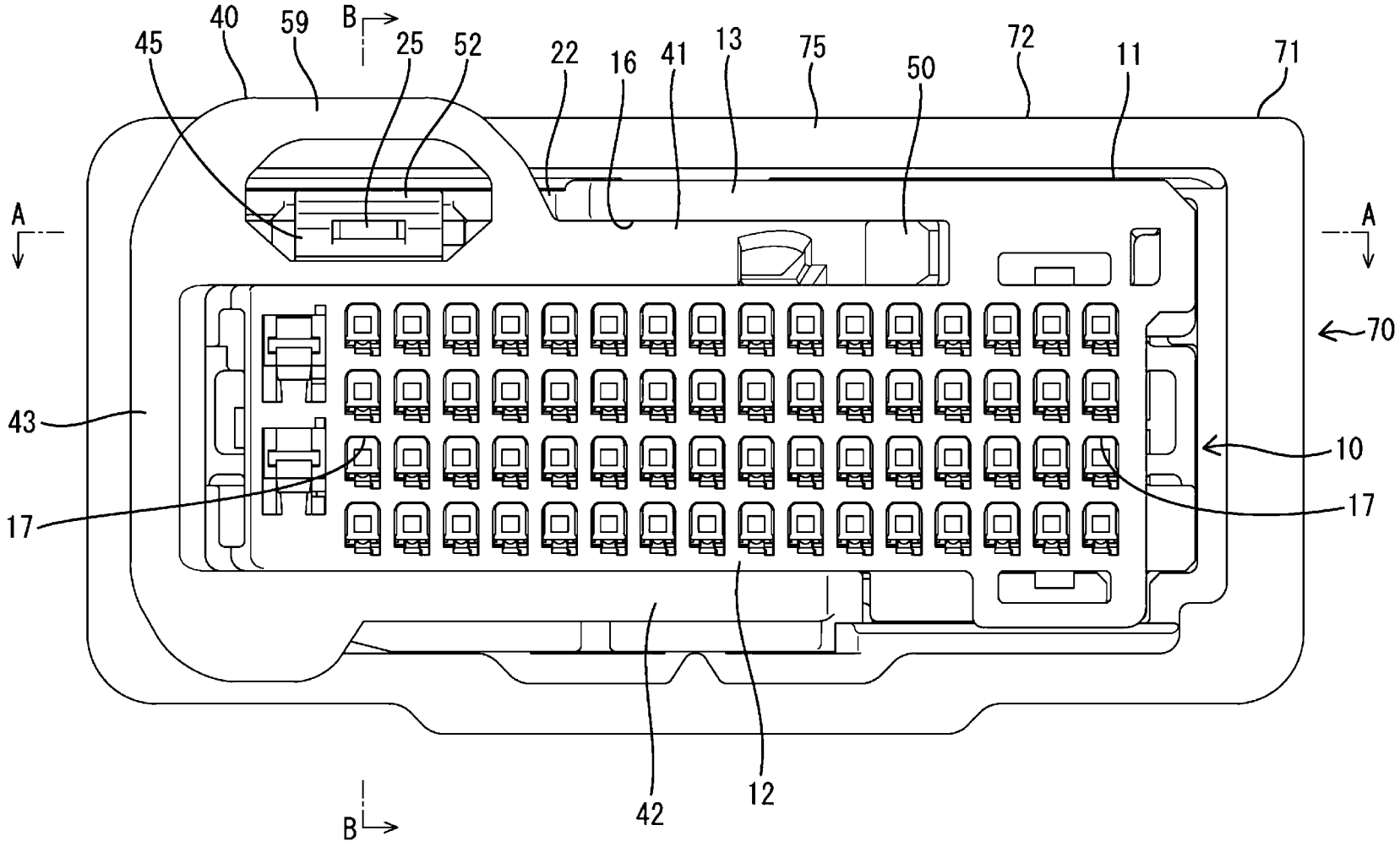
FIG. 1 is a back view viewed from the side of a first housing showing a state where the first housing and a second housing are held in a connected state in a connector according to an embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a first housing, a second housing connectable to the first housing, and a lever rotatably supported on the first housing, wherein the lever includes a lever lock portion for holding the first and second housings in a connected state, the first housing includes a first locking portion and the second housing has a second locking portion, and the first and second locking portions are arranged side by side with each other to constitute an integrated locking portion and arranged to be lockable to the lever lock portion with the first and second housings connected.

According to the above configuration, a load is dispersed to each of the first and second locking portions by the lever lock portion being locked to the locking portion. Thus, the size of only the first locking portion or only the second locking portion needs not be changed to a larger size for the load from the lever lock portion. As a result, the enlargement of the first or second housing can be suppressed and, moreover, a holding force by the lever can be enhanced. Note that "arranged side by side with each other to constitute an integrated locking portion" means that the first and second locking portions are arranged side by side with each other, thereby being shaped to be integrated as the "locking portion," and the "locking portion" integrally receives the load from the lever lock portion.

(2) Preferably, the lever lock portion includes a lock body portion, the second locking portion has a locking surface facing the lock body portion and a second facing surface located on a side opposite to the locking surface, the first locking portion has a first facing surface facing the second facing surface, and the lock body portion, the locking surface, the second facing surface and the first facing surface are arranged side by side on a straight line along a connecting direction with the first and second housings connected.

According to the above configuration, the load from the lock body portion is efficiently dispersed to the second and first locking portions by way of the locking surface, the second facing surface and the first facing surface.

(3) The second and first facing surfaces may be arranged to contact each other along a direction intersecting the connecting direction.

According to the above configuration, the load from the lock body portion is more efficiently dispersed to the second and first locking portions by way of a contact region of the second and first facing surfaces.

(4) The lever may include a plate-like lever body portion having the lever lock portion, the first housing may include a housing body, a covering wall and an accommodation space formed between the housing body and the covering wall, the first locking portion may project into the accommodation space from the covering wall, a projecting amount of the lever body portion from an opening of the accommodation space may be reduced by rotation of the lever, and the lever body portion may be accommodated in the accommodation space and the first locking portion may be arranged to face the lock body portion from the opening side with the first and second housings connected.

According to the above configuration, the first locking portion contacts the lock body portion with the lever body portion accommodated in the accommodation space, whereby the lever body portion is restricted from rotating in a direction to project from the opening of the accommodation space. Thus, in a state before the first and second housings are connected, the lever body portion can be accommodated into the accommodation space and the lever and the first housing can be transported in a compact form.

(5) The first locking portion may have a guiding surface inclined to approach the first facing surface as being separated from the covering wall on a side opposite to the first facing surface.

According to the above configuration, after sliding along the guiding surface, the lock body portion can smoothly enter the accommodation space.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Figure 2:
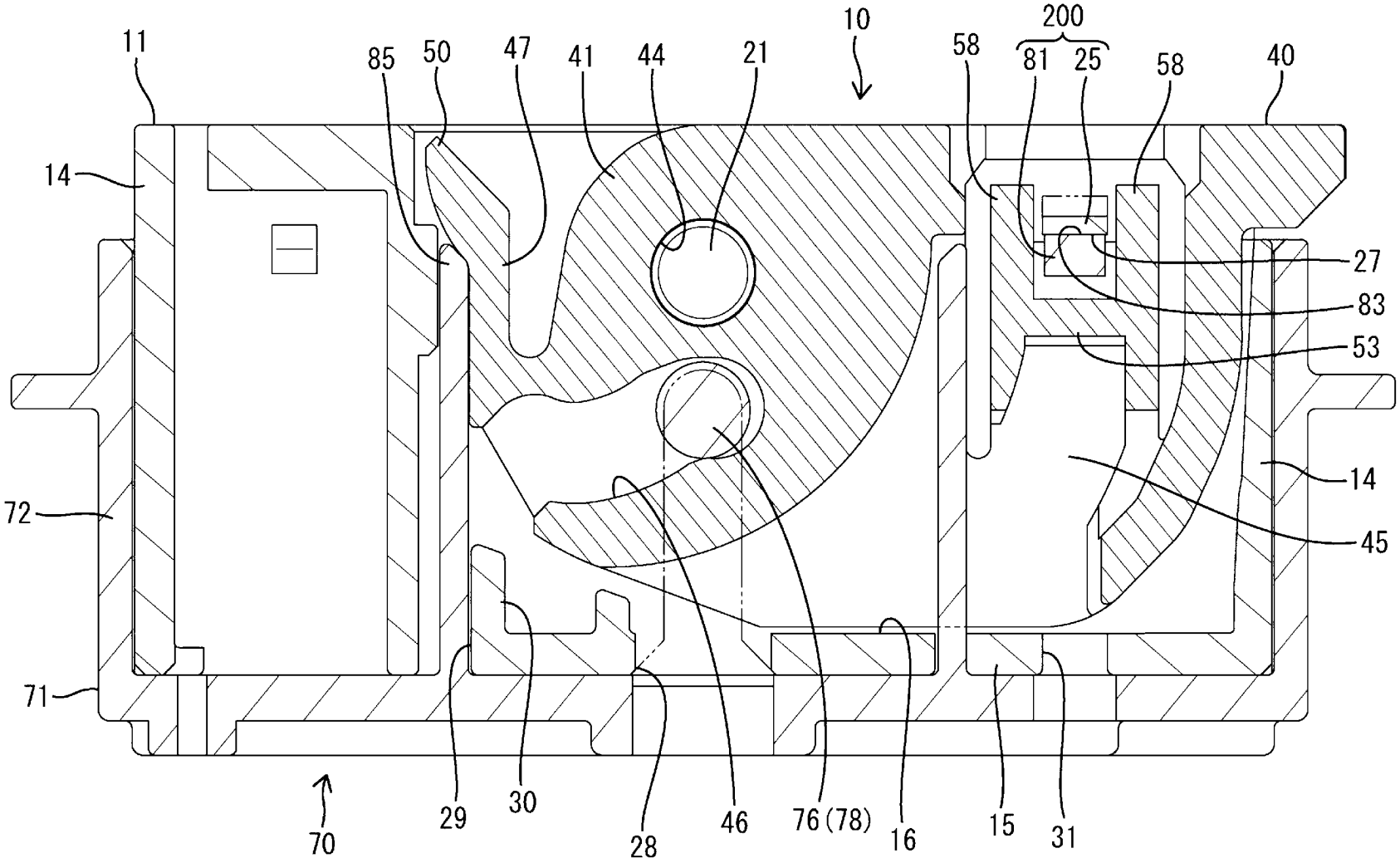
FIG. 2 is a section along A-A of FIG. 1.
Figure 3:
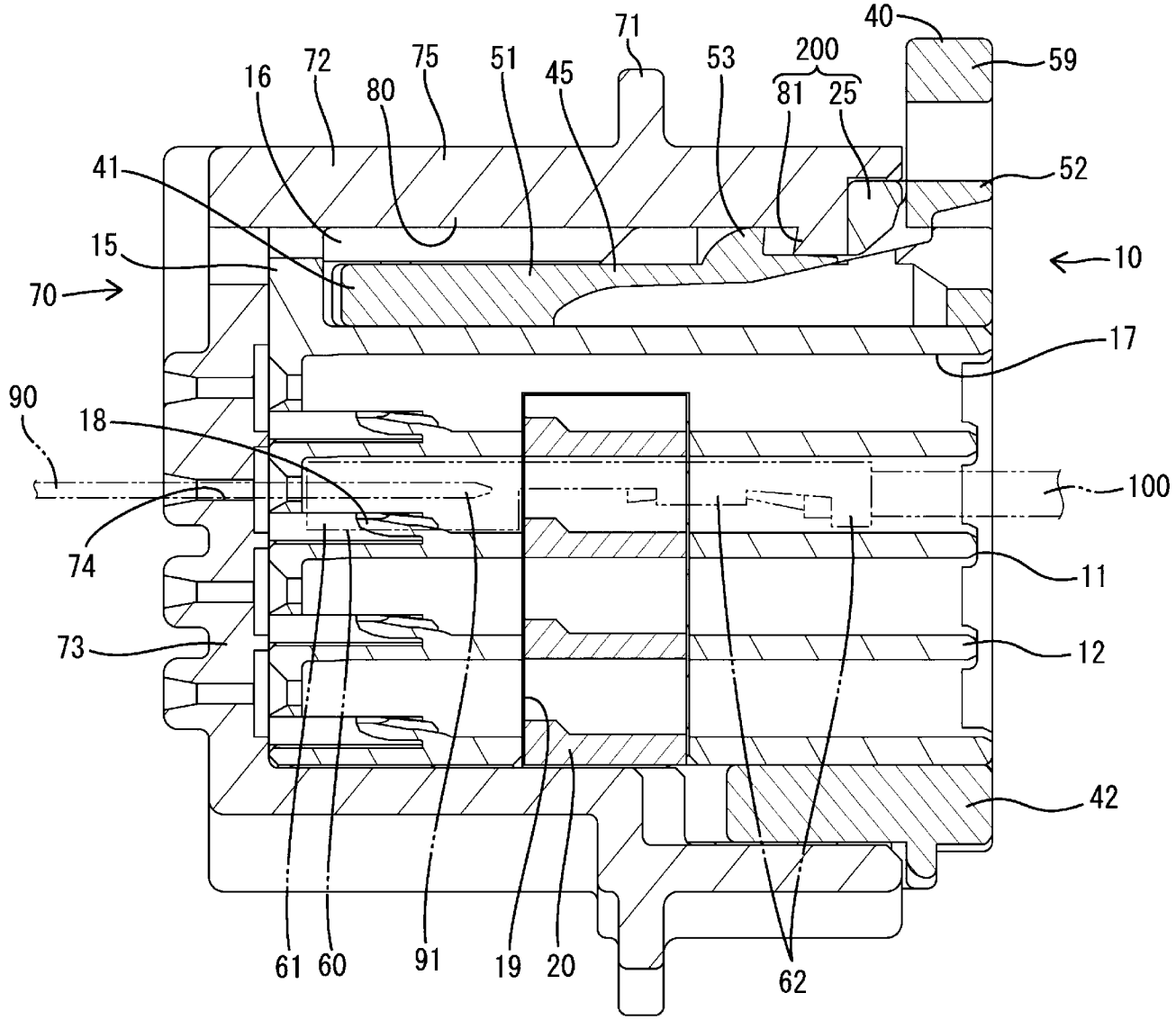
FIG. 3 is a section along B-B of FIG. 1.

As shown in FIGS. 1 to 3, a connector according to an embodiment is composed of a female connector 10 and a male connector 70. As shown in FIG. 3, the male connector 70 includes a second housing 71 and second terminals 90. The female connector 10 includes a first housing 11, a retainer 20, first terminals 60 and a lever 40.

The first terminals 60 are accommodated into the first housing 11. The second terminals 90 are mounted into the second housing 71. The lever 40 is rotatably supported on the first housing 11. The first and second housings 11, 71 are connected to each other by the rotation of the lever 40. Note that, in the following description, surface sides of the first and second housings 11, 71 facing each other when connection is started are referred to as front sides concerning a front-rear direction. A vertical direction is based on figures except FIGS. 2, 6 and 9. A lateral direction is based on figures except FIGS. 3 to 5. These direction references do not necessarily coincide with directions during actual use.

(Second Housing)

Figure 7:
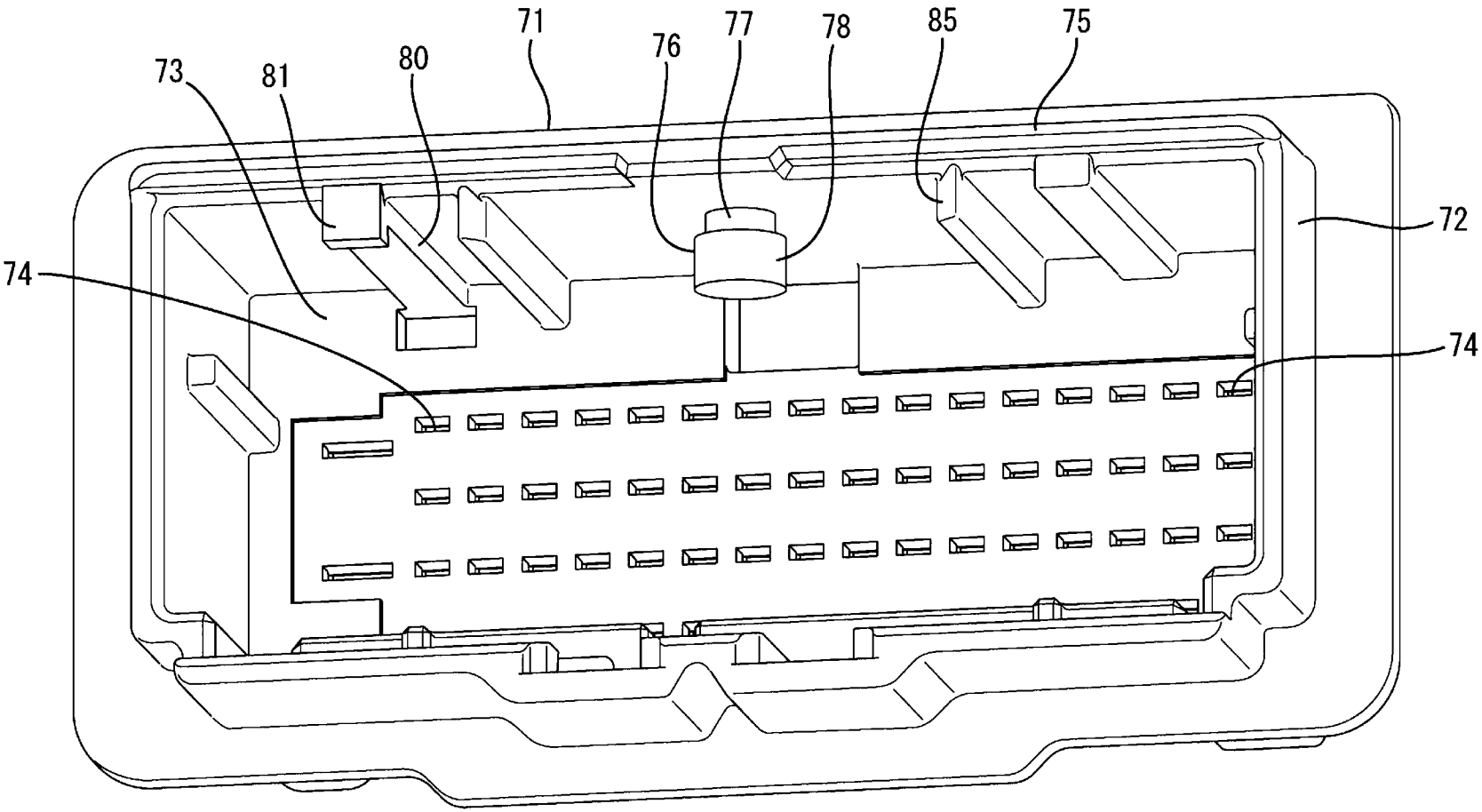
FIG. 7 is a perspective view of the second housing.

The second housing 71 is made of synthetic resin and includes, as shown in FIG. 7, a receptacle 72 in the form of a rectangular tube long in the lateral direction. The receptacle 72 is shaped to project forward from the outer edge of a back wall 73. The back wall 73 is provided with a plurality of tab mounting holes 74 penetrating therethrough. The respective tab mounting holes 74 are arranged in a plurality of rows in the vertical direction and a plurality of columns in the lateral direction in the back wall 73.

Figure 5:
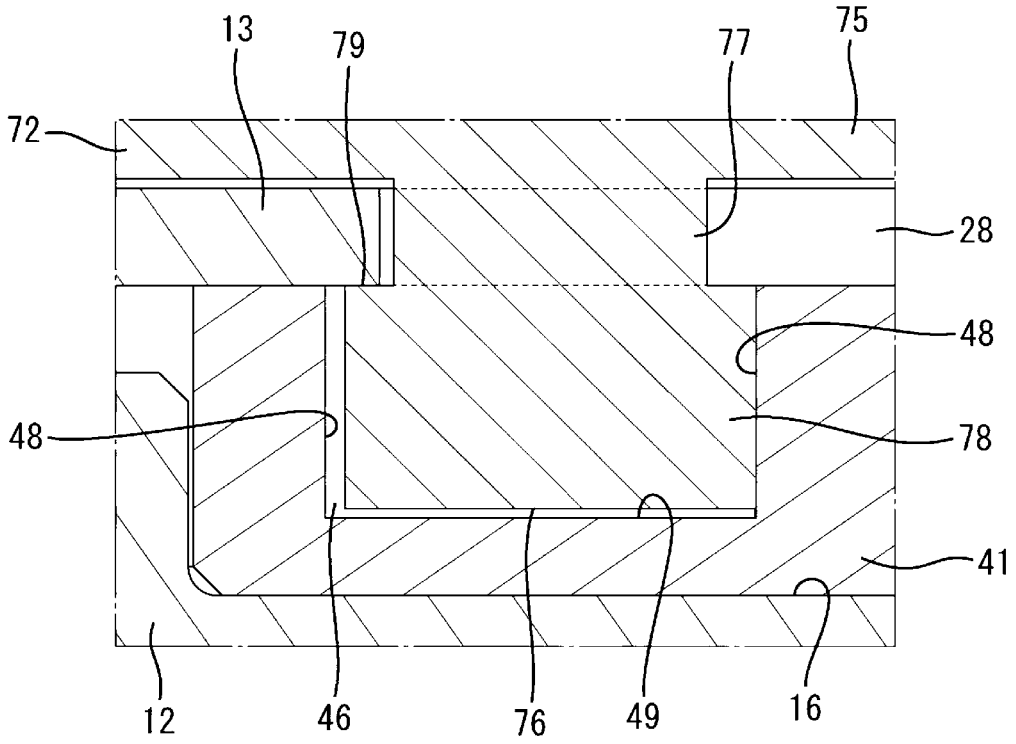
FIG. 5 is an enlarged section of a part where a cam pin is arranged in a cam groove.

The second housing 71 includes a cam pin 76 projecting downward from a laterally central side of an upper wall 75 of the receptacle 72. The cam pin 76 has a cylindrical shape and includes a base end portion 77 located on a base end side and a tip portion 78 located on a tip side and having a larger diameter than the base end portion 77. A vertical dimension of the tip portion 78 is larger than that of the base end portion 77. As shown in FIG. 5, the vertical dimension of the base end portion 77 corresponds to a vertical dimension (plate thickness) of a later-described covering wall 13, and that of the tip portion 78 corresponds to a vertical dimension (depth) of a later-described cam groove 46. The upper surface of the tip portion 78 serves as a radially arranged flange surface 79.

As shown in FIG. 7, the second housing 71 includes a rib-like extending portion 80 extending in the front-rear direction on the inner side of one lateral side (left side of FIG. 7) of the upper wall 75 of the receptacle 72. The extending portion 80 has a rectangular cross-sectional shape. Further, the second housing 71 includes a second locking portion 81 integrally coupled to the front end of the extending portion 80 and projecting downward. The second locking portion 81 is arranged to be retracted rearward from the front end of the upper wall 75 of the receptacle 72.

Figure 4:
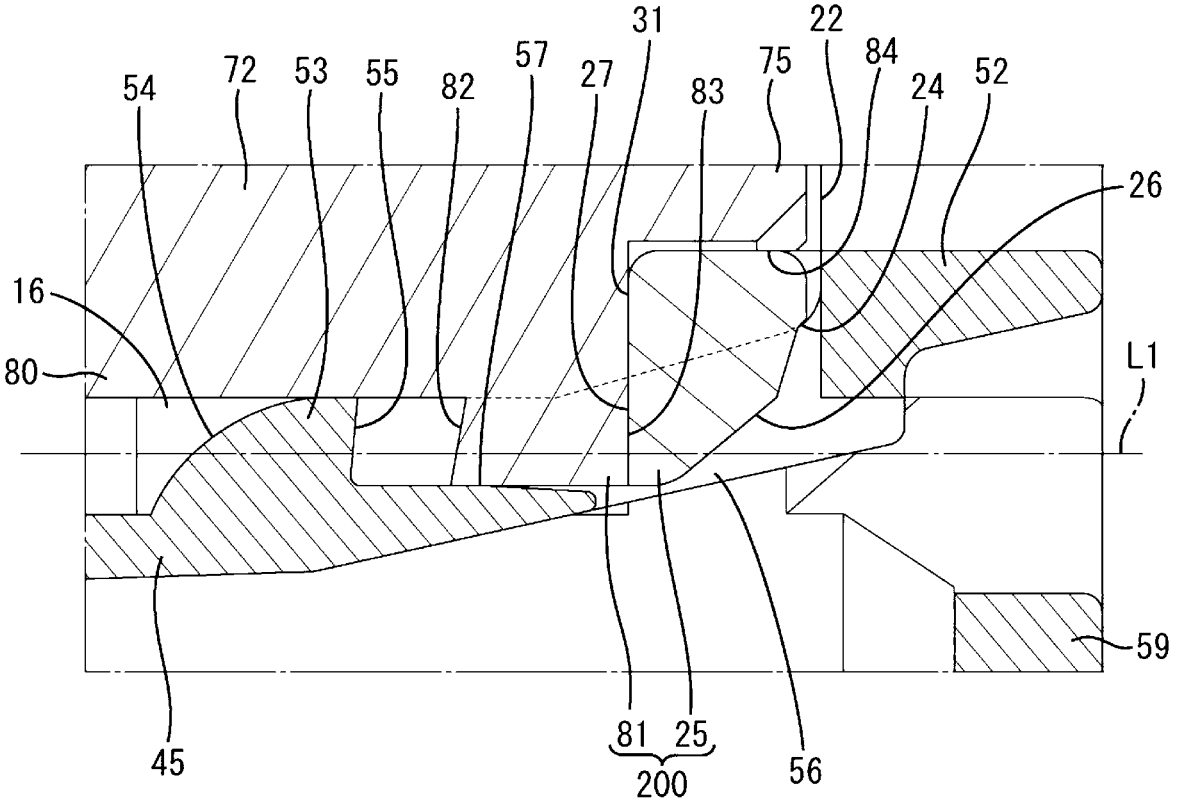
FIG. 4 is an enlarged section of a part where a lever lock portion is arranged to be lockable to a locking portion composed of a first locking portion and a second locking portion in FIG. 3.

As shown in FIG. 4, the rear surface of the second locking portion 81 serves as a locking surface 82 inclined rearward toward a lower side. The front surface of the second locking portion 81 serves as a second facing surface 83 arranged along the vertical direction. The lower surface of the second locking portion 81 is arranged along the front-rear direction. The inner surface of the upper wall 75 of the receptacle 72 has a covering surface 84 between the front end of the upper wall 75 and the second facing surface 83. The covering surface 84 is continuous in the front-rear direction via a step.

As shown in FIG. 7, the second housing 71 includes a rib-like releasing portion 85 extending in the front-rear direction on the inner surface of the other lateral side (right side of FIG. 7) of the upper wall 75 of the receptacle 72.

(Second Terminals)

The second terminal 90 is made of conductive metal and, as shown in FIG. 3, includes a tab 91 extending in the front-rear direction. The tab 91 is mounted through the tab mounting hole 74 of the back wall 73 of the second housing 71. A rear end part of the second terminal 90 is exposed rearward from the back wall 73 and connected to an unillustrated circuit board by soldering.

(First Housing)

Figure 8:
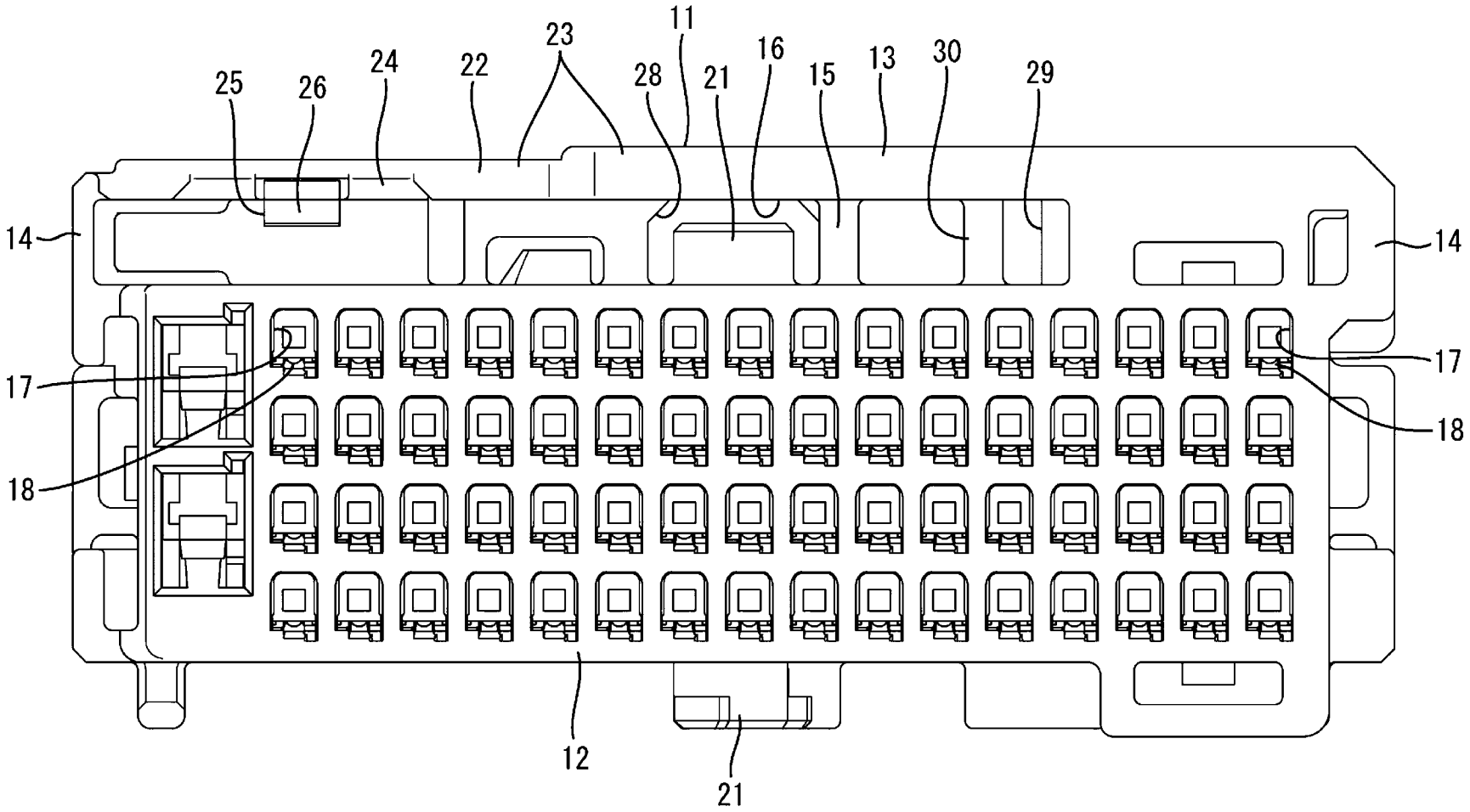
FIG. 8 is a back view of the first housing.

The first housing 11 is made of synthetic resin and, as shown in FIGS. 1 to 3, fit into the receptacle 72. As shown in FIG. 8, the first housing 11 includes a housing body 12 in the form of a rectangular block long in the lateral direction, the covering wall 13 arranged above the housing body 12 and a pair of side portions 14 linking both left and right end parts of the housing body 12 and the covering wall 13. Further, the first housing 11 includes a front wall 15 linking front end parts of the housing body 12, the covering wall 13 and the respective side portions 14. In the first housing 11, an accommodation space 16 open rearward is defined among the housing body 12, the covering wall 13, the respective side portions 14 and the front wall 15. When the first housing 11 is viewed from behind, the accommodation space 16 has an opening shaped to be long in the lateral direction.

The housing body 12 includes a plurality of cavities 17 at positions corresponding to the respective tab mounting hole 74. The housing body 12 includes deflectable and deformable locking lances 18 projecting forward from inner walls of the respective cavities 17. As shown in FIG. 3, the housing body 12 includes a retainer mounting hole 19. The retainer mounting hole 19 is open in the lower surface of the housing body 12 and communicates with the respective cavities 17 in the housing body 12. The retainer 20 is inserted into the retainer mounting hole 19 from below.

As shown in FIG. 8, the first housing 11 includes a support shaft 21 projecting into the accommodation space 16 from a laterally central side of the upper surface of the housing body 12. The support shaft 21 has a cylindrical shape and is also provided on the lower surface of the housing body 12.

Figure 6:
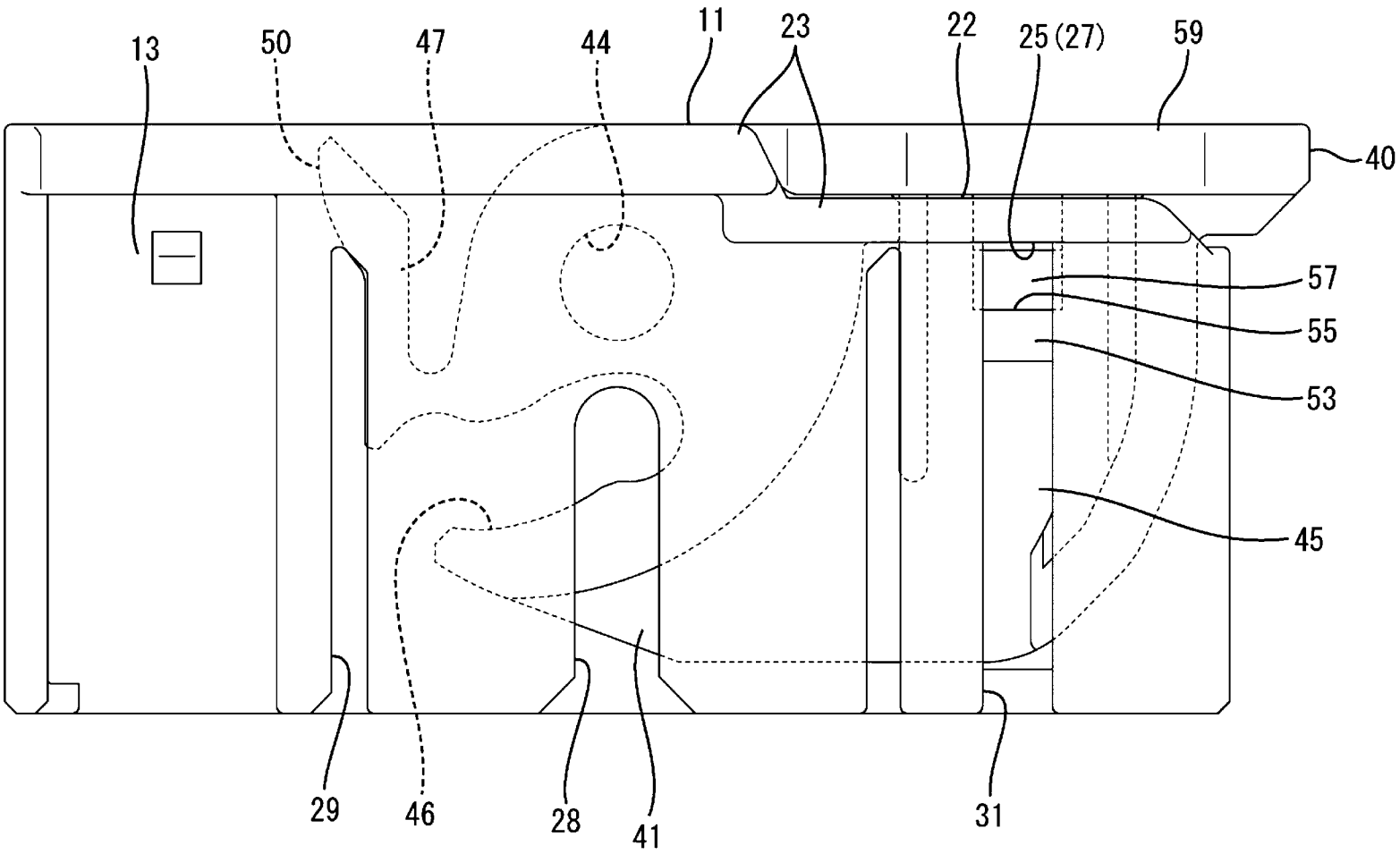
FIG. 6 is a plan view showing a state where a lever body portion is accommodated in an accommodation space of the first housing.

As shown in FIG. 6, the first housing 11 includes a retracted portion 22 shaped to be recessed forward on one lateral side (right side of FIG. 6) of the rear end of the covering wall 13. A ridge portion 23 extending in the lateral direction including the retracted portion 22 is provided on the rear end of the covering wall 13. As shown in FIG. 8, a height of the ridge portion 23 is slightly lower on the side of the retracted portion 22. The retracted portion 22 has a guiding surface 24 inclined toward the inside of the accommodation space 16 below the ridge portion 23.

Further, the first housing 11 includes a first locking portion 25 projecting into the accommodation space 16 from the covering wall 13. As shown in FIG. 4, the first locking portion 25 is in the form of a claw connected to the guiding surface 24 of the retracted portion 22.

As shown in FIG. 4, the front surface of the first locking portion 25 serves as a first facing surface 27 arranged along the vertical direction. The first facing surface 27 is in surface contact with the second facing surface 83 along the vertical direction. A lateral width of the first facing surface 27 is equal to that of a later-described second locking portion introducing hole 31 and, as shown in FIG. 2, somewhat larger than that of the second facing surface 83 (see FIG. 6).

As shown in FIG. 4, the rear surface of the first locking portion 25 has a guiding surface 26 inclined toward the inside of the accommodation space 16. Specifically, the guiding surface 26 is inclined in a tapered manner to approach the first facing surface 27 toward a lower side in a direction away from the covering wall 13.

As shown in FIG. 2, the first housing 11 includes a cam pin introducing hole 28 on a laterally central side of the front wall 15 and includes a releasing portion introducing hole 29 on the other lateral side (left side of FIG. 2) of the front wall 15. Both the cam pin introducing hole 28 and the releasing portion introducing hole 29 penetrate through the front wall 15 in the front-rear direction. Further, the first housing 11 includes a partial lock receiving portion 30 projecting into the accommodation space 16 between the releasing portion introducing hole 29 and the cam pin introducing hole 28 in the front wall 15.

As shown in FIG. 6, the cam pin introducing hole 28 and the releasing portion introducing hole 29 are shaped into grooves extending in the front-rear direction in the covering wall 13. Further, a second locking portion introducing hole 31 in the form of a groove extending in the front-rear direction is also provided on one lateral side (right side of FIG. 6) of the covering wall 13. The front end of the second locking portion introducing hole 31 is open in the front wall 15. As shown in FIG. 4, the rear end of the second locking portion introducing hole 31 serves as an end surface continuous with the first facing surface 27 without any step.

(First Terminals)

The first terminal 60 is made of conductive metal and includes, as shown in FIG. 3, a connecting portion 61 in the form of a rectangular tube and a barrel portion 62 in the form of an open barrel connected behind the connecting portion 61. The tab 91 is inserted into the connecting portion 61 for connection. The barrel portion 62 is connected to an end part of a wire 100. The first terminal 60 is inserted into the cavity 17 of the housing body 12 from behind. In a state inserted in the cavity 17, the first terminal 60 is primarily locked by the locking lance 18 and, subsequently, secondarily locked by the retainer 20.

(Lever)

Figure 10:
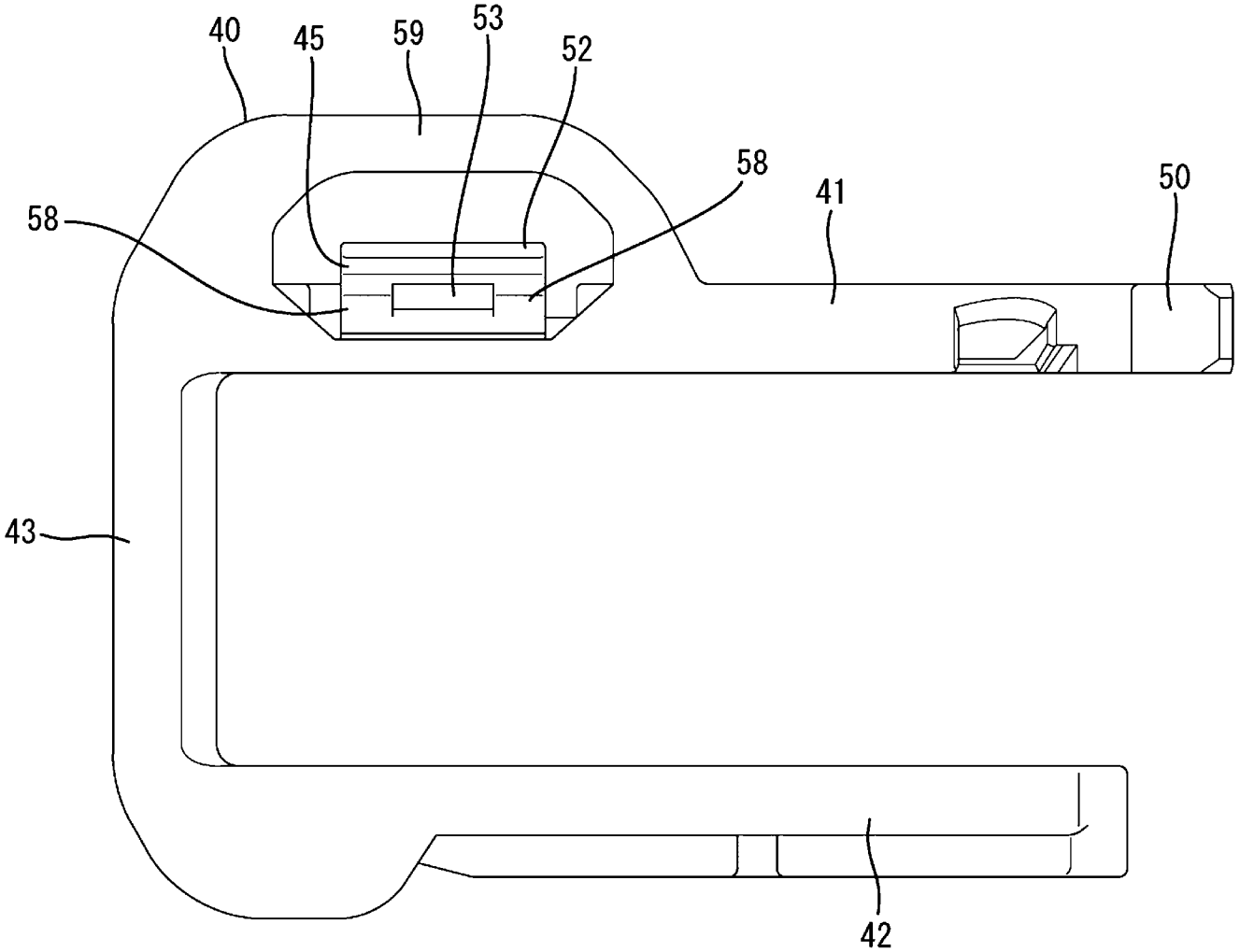
FIG. 10 is a back view of the lever.

The lever 40 is made of synthetic resin and, as shown in FIG. 10, gate-shaped as a whole. The lever 40 includes a plate-like lever body portion 41 arranged along the lateral direction, a plate-like assisting portion 42 arranged in parallel to the lever body portion 41 below the lever body portion 41 and a coupling portion 43 extending in the vertical direction and coupling one lateral ends (left ends of FIG. 10) of the lever body portion 41 and the assisting portion 42. As shown in FIGS. 1 to 3, the lever body portion 41 is accommodated in the accommodation space 16. The assisting portion 42 is arranged along the lower surface of the housing body 12.

Figure 9:
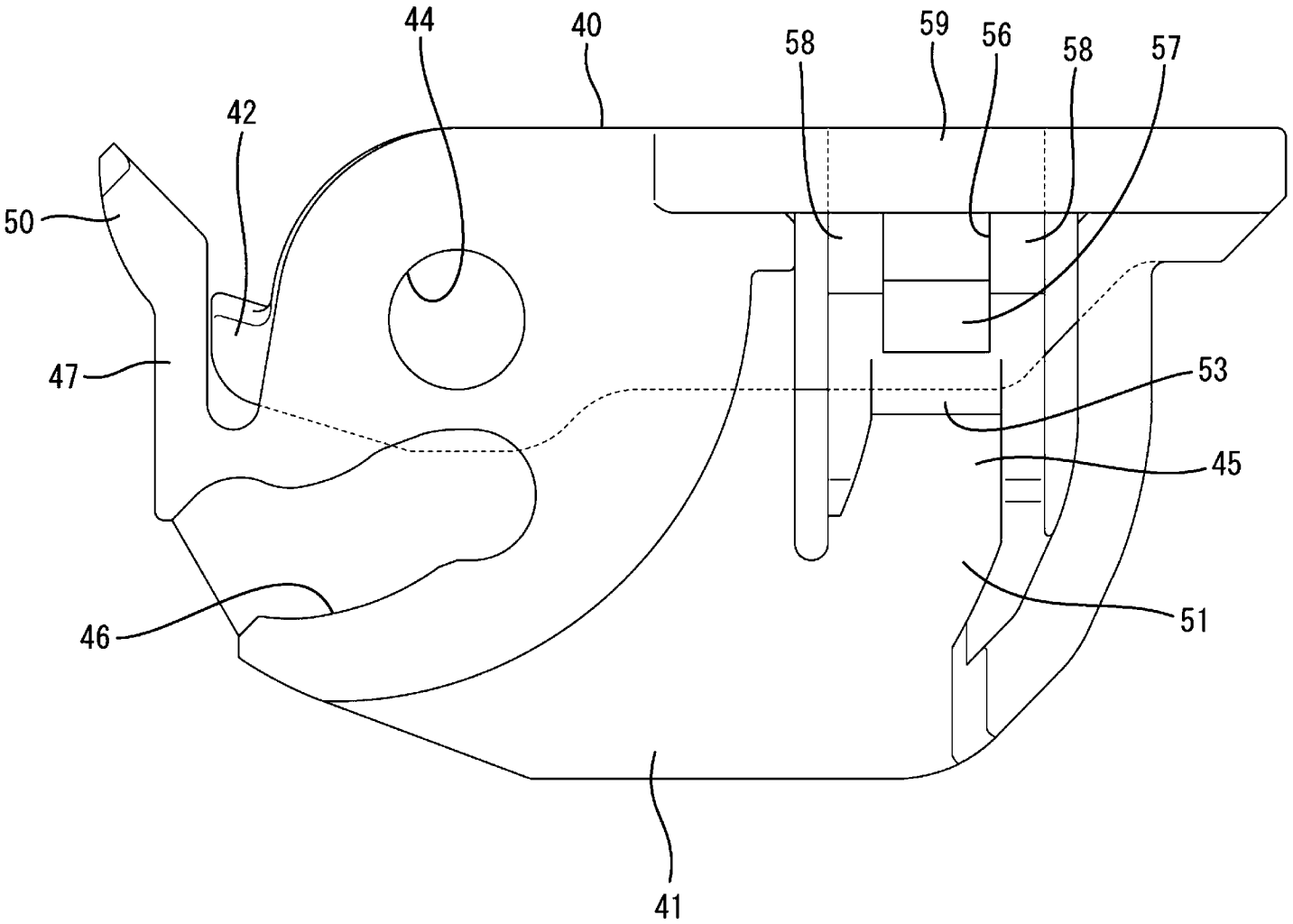
FIG. 9 is a plan view of a lever.

As shown in FIG. 9, the lever body portion 41 and the assisting portion 42 are respectively provided with shaft holes 44 (only the shaft hole 44 of the lever body portion 41 is shown in FIG. 9). The corresponding support shafts 21 are fit into the respective shaft holes 44. The lever 40 is rotated between a partial locking position and a full locking position about the support shafts 21 fit in the respective shaft holes 44. A worker can rotate the lever 40 while pinching the coupling portion 43.

As shown in FIG. 9, the lever body portion 41 includes a lever lock portion 45 on one lateral side (right side of FIG. 9) and the cam groove 46, a partial locking portion 47 and the upper shaft hole 44 on the other lateral side (left side of FIG. 9).

The cam groove 46 is a bottomed groove recessed in one surface (upper surface) of the lever body portion 41 and one end thereof in an extending direction is open in the outer peripheral edge of the lever body portion 41. Specifically, as shown in FIG. 5, the cam groove 46 has a recessed cross-section and is defined by a pair of side surfaces 48 arranged along the vertical direction and a bottom surface 49 connected to the lower ends of the both side surfaces 48 and arranged along the lateral direction.

As shown in FIG. 9, the partial locking portion 47 is shaped to extend rearward from the vicinity of the cam groove 46 on the outer peripheral edge of the lever body portion 41. The partial locking portion 47 includes a projection 50 bent toward the other side on a tip part.

The lever lock portion 45 is deflectably and deformably arranged between a pair of cuts formed on both left and right sides. The lever lock portion 45 is in the form of a plate extending in the front-rear direction from a front end to a rear end while having a constant width. As shown in FIG. 3, a deflection fulcrum portion 51 is provided on a front end side of the lever lock portion 45. An unlocking portion 52 is provided on a rear end side of the lever lock portion 45.

The lever lock portion 45 includes a lock body portion 53 between the deflection fulcrum portion 51 and the unlocking portion 52. The lock body portion 53 projects upward from a central side in the front-rear direction of the lever lock portion 45 and is, as shown in FIG. 9, in the form of a rib extending in the lateral direction. As shown in FIG. 4, the front surface of the lock body portion 53 serves as a guide surface 54 inclined rearward in a curved manner toward an upper side. The rear surface of the lock body portion 53 serves as a lock surface 55 inclined rearward in a tapered manner toward the upper side.

The unlocking portion 52 is arranged to be slightly higher than the lock body portion 53. The lever lock portion 45 includes a lock hole 56 penetrating in the vertical direction between the lock body portion 53 and the unlocking portion 52 and behind the lock body portion 53. The upper surface of the lever lock portion 45 has a receiving surface 57 arranged along the front-rear direction between the lock body portion 53 and the lock hole 56. Further, the lever lock portion 45 includes a pair of linking portions 58 linking both left and right end parts of the unlocking portion 52 and the lever lock portion 45 on both left and right sides of the lock hole 56 (see FIGS. 9 and 10).

As shown in FIG. 10, the lever body portion 41 includes a protecting portion 59 surrounding the outer periphery of the unlocking portion 52. The protecting portion 59 is arranged on one lateral side (left side of FIG. 10) of a rear end part of the lever body portion 41. The protecting portion 59 includes a bridge part covering the unlocking portion 52 from above.

(Connection Structure of Connector)

By inserting the lever body portion 41 into the accommodation space 16 and locking the partial locking portion 47 to the projection 50 of the partial lock receiving portion 30, the lever 40 is held at the partial locking position with respect to the first housing 41. At the partial locking position, the entrance of the cam groove 46 is arranged to face forward while communicating with the cam pin introducing hole 28. Further, at the partial locking position, the protecting portion 59 of the lever body portion 41 is arranged to be separated rearward from an opening of the accommodation space 16.

When the female connector 10 is transported, the lever 40 is arranged at the full locking position with respect to the first housing 11. In the process of moving the lever 40 toward the full locking position, a projecting amount of the lever body portion 41 from the opening of the accommodation space 16 is gradually reduced. Further, the guide surface 54 of the lock body portion 53 slides on the guiding surface 26 of the first locking portion 25 and the lever lock portion 45 is deflected and deformed downward with the deflection fulcrum portion 51 as a fulcrum. When the lever 40 reaches the full locking position, the lever lock portion 45 resiliently returns and, as shown in FIG. 6, the lock body portion 53 is arranged in front of the first locking portion 25. The first locking portion 25 is arranged on the opening side, which is a rear end side, of the accommodation space 16, and arranged to face the lock body portion 53 from the opening side of the accommodation space 16.

If the lever 40 is going to be rotated in a return direction from the full locking position to the partial locking position, the lock surface 55 of the lock body portion 53 contacts the first facing surface 27 of the first locking portion 25 to hinder any further rotation of the lever 40. Thus, with the lever body portion 41 accommodated in the accommodation space 16, the first housing 11 and the lever 40 can be transported in a compact form.

When the lever 40 is at the full locking position, the lever body portion 41 is accommodated in the accommodation space 16 except the protecting portion 59 and the unlocking portion 52 arranged on an end part. As shown in FIG. 6, the protecting portion 59 is fit in the retracted portion 22 and arranged along the ridge portion 23.

Prior to the connection of the female connector 10 and the male connector 70, the first terminals 60 are accommodated into the first cavities 17 of the first housing 11 and the lever 40 is arranged at the unillustrated partial locking position with respect to the first housing 11. Further, the second terminals 90 are mounted into the second housing 71. In that state, the first housing 11 is fit into the receptacle 72 of the second housing 71. Then, the cam pin 76 enters the cam pin introducing hole 28 and the entrance of the cam groove 46 and an upper part (extending portion 80) of the second locking portion 81 enters the second locking portion introducing hole 31. Further, the releasing portion 85 enters the releasing portion introducing hole 29 to interfere with the projection 50. The partial locking portion 47 is pressed by the releasing portion 85, whereby a locked state to the partial lock receiving portion 30 is released. In this way, the lever 40 becomes rotatable toward the full locking position.

If the lever 40 is rotated toward the full locking position, the cam pin 76 slides on the side surface 48 of the cam groove 46 and the connection of the first and second housings 11, 71 proceeds. Specifically, as shown in FIG. 5, the tip portion 78 of the cam pin 76 is inserted into the cam groove 46 and the base end portion 77 of the cam pin 76 is inserted into the cam pin introducing hole 28. The flange surface 79 of the tip portion 78 is arranged to face the lower surface of the covering wall 13 and sandwich the covering wall 13 between the upper wall 75 of the receptacle 72 and the flange surface 79. By the contact of the flange surface 79 of the tip portion 78 with the lower surface of the covering wall 13, a displacement of the cam pin 76 in a direction (upward direction of FIG. 5) to come out from the cam groove 46 is restricted.

Conventionally, the escape of a cam pin has been prevented by bringing a flange part of the cam pin into contact with a step formed on a side surface of a cam groove. In contrast, in this embodiment, the escape of the cam pin 76 is prevented without forming any step on the side surface 48 of the cam groove 46. Thus, the structure of the lever 40 can be more simplified than before and, moreover, a mold slide structure for forming a step in the cam groove 46 can be omitted. Therefore, mold cost can be reduced.

In the process of moving the lever 40 toward the full locking position, the extending portion 80 is displaced in the second locking portion introducing hole 31. Further, as described above, the guide surface 54 of the lock body portion 53 slides on the guiding surface 26 of the first locking portion 25 and the lever lock portion 45 is guided into the accommodation space 16. With the lock body portion 53 inserted in the accommodation space 16, the lower end of the second locking portion 81 slides on the guide surface 54 of the lock body portion 53 and the lever lock portion 45 is deflected and deformed downward with the deflection fulcrum portion 51 as a fulcrum.

When the lever 40 reaches the full locking position, the lever lock portion 45 resiliently returns and, as shown in FIG. 4, the lock body portion 53, the second locking portion 81 and the first locking portion 25 are arranged side by side on a straight line L1 along the front-rear direction. The first locking portion 25 is fit into an L-shaped space formed between the second facing surface 83 and the covering surface 84.

Specifically, the locking surface 82 of the second locking portion 81 is arranged behind the lock surface 55 of the lock body portion 53 to face the lock surface 55. The lower surface of the second locking portion 81 is arranged to contact the receiving surface 57 of the lever lock portion 45. The covering surface 84 of the upper wall 75 of the receptacle 72 is arranged to contact the upper surface of the covering wall 13. Further, the second facing surface 83 of the second locking portion 81 and the first facing surface 27 of the first locking portion 25 are arranged to contact each other along the vertical direction. More specifically, the second facing surface 83 of the second locking portion 81 is arranged to contact the first facing surface 27 of the first locking portion 25 over an entire height. The respective lower ends of the first and second facing surfaces 27, 83 are arranged to be continuous with each other at the same height. In this way, the first and the second locking portions 25, 81 are arranged side by side in the front-rear direction while contacting each other, thereby forming a locking portion 200 in which the first and second locking portions 25, 81 are integrally united.

If the first housing 11 or the wires 100 connected to the first terminals 60 is/are pulled rearward (rearward when viewed from the side of the first housing 11), the first housing 11 moves in a direction away from the second housing 71 and the lock surface 55 of the lock body portion 53 contacts the locking surface 82 of the second locking portion 81. Thus, the second locking portion 81 receives a load from the lever lock portion 45. However, in the case of this embodiment, the load from the lever lock portion 45 is dispersed to each of the first and second locking portions 25, 81 constituting the locking portion 200 without concentrating only on the second locking portion 81. Thus, the load from the lever lock portion 45 is stably received by the locking portion 200 with the lock surface 55 of the lock body portion 53 held in contact with the locking surface 82 of the second locking portion 81. In this way, the lever 40 reaches the full locking position, whereby the first and second housings 11, 71 are held in the connected state. Further, when the lever 40 reaches the full locking position, the first and second terminals 60, 90 are properly connected.

In separating the first and second housings 11, 71, the unlocking portion 52 is pushed downward, a locked state of the lock body portion 53 and the second locking portion 81 is released by pulling down the lever lock portion 45 and, in that state, the first and second housings 11, 71 may be pulled apart from each other.

As described above, according to this embodiment, the lever lock portion 45 is locked to the locking portion 200, whereby a load is dispersed to each of the first and second locking portions 25, 81. Thus, the size of the first or second locking portion 25, 81 needs not be changed to a larger size for the load from the lever lock portion 45. As a result, the enlargement of the first or second housing 11, 71 can be suppressed and, moreover, a holding force by the lever 40 can be enhanced.

Further, since the lock body portion 53, the locking surface 83, the second facing surface 83 and the first facing surface 27 are arranged side by side on the straight line L1 shown in FIG. 4 along the front-rear direction, a load from the lock body portion 53 is efficiently dispersed to the second and first locking portions 81, 25 by way of the locking surface 82, the second facing surface 83 and the first facing surface 27 when a rearward pulling force is applied to the first housing 11.

Further, since the second and first facing surfaces 83, 27 contact each other along the vertical direction orthogonal to the front-rear direction, a rearward load from the lock body portion 53 is more efficiently dispersed to the second and first locking portions 81, 25 via a contact region of the second and first facing surfaces 83, 27.

Further, since the first locking portion 25 is arranged to face and be lockable to the lock body portion 53 from the opening side of the accommodation space 16, the lever body portion 41 is restricted from rotating in a direction to project from the opening of the accommodation space 16. As a result, the lever 40 and the first housing 11 can be transported in a compact form.

Furthermore, since the first locking portion 25 is provided with the tapering guiding surface 26, the lock body portion 53 can slide along the guiding surface 26 and smoothly enter the accommodation space 16 in the process of rotating the lever 40 to the full locking position.

Other Embodiments of Present Disclosure

The embodiment disclosed this time should be considered illustrative in all aspects, rather than restrictive.

Although the first housing supporting the lever is a housing constituting the female connector in the case of the above embodiment, a first housing supporting a lever may be a housing constituting a male connector according to another embodiment.

Although the first and second locking portions are arranged side by side in the front-rear direction, which is a connecting direction, in the case of the above embodiment, first and second locking portions may be arranged side by side in a lateral direction, which is a direction orthogonal to a connecting direction, according to another embodiment. If the first and second locking portions are arranged side by side in the lateral direction, the both first and second locking portions can have locking surfaces to be locked to a lock body portion.

Although the first facing surface of the first locking portion and the second facing surface of the second locking portion are arranged to come into surface contact with each other in the case of the above embodiment, a first facing surface of a first locking portion and a second facing surface of a second locking portion may be arranged to contact while having a clearance therebetween according to another embodiment.

Although the guiding surface of the first locking portion is inclined in a tapered manner in the case of the above embodiment, a guiding surface of a first locking portion may be inclined in a curved manner according to another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a first housing;

a second housing connectable to the first housing; and a lever rotatably supported on the first housing, wherein:

the lever includes a lever lock portion that is deflectably and deformably arranged between a pair of cuts formed on both left and right sides and is in a form of a plate extending in a front-rear direction from a front end to a rear end while having a constant width, and the lever lock portion including a lock body portion projecting upward from one side of the lever lock portion and configured to hold the first and second housings in a connected state, the first housing includes a first locking portion and the second housing has a second locking portion, and the first and second locking portions are arranged side by side with each other to constitute an integrated locking portion and arranged to be lockable to the lock body portion with the first and second housings connected.

2. The connector of claim 1, wherein:

the second locking portion has a locking surface facing the lock body portion and a second facing surface located on a side opposite to the locking surface, the first locking portion has a first facing surface facing the second facing surface, and the lock body portion, the locking surface, the second facing surface and the first facing surface are arranged side by side on a straight line along a connecting direction with the first and second housings connected.

3. The connector of claim 2, wherein the second and first facing surfaces are arranged to contact each other along a direction intersecting the connecting direction.

4. The connector of claim 2, wherein:

the lever includes a plate-like lever body portion having the lever lock portion, the first housing includes a housing body, a covering wall and an accommodation space formed between the housing body and the covering wall, the first locking portion projects into the accommodation space from the covering wall, a projecting amount of the lever body portion from an opening of the accommodation space is reduced by rotation of the lever, and the lever body portion is accommodated in the accommodation space and the first locking portion is arranged to face the lock body portion from the opening side with the first and second housings connected.

5. The connector of claim 4, wherein the first locking portion has a guiding surface inclined to approach the first facing surface as being separated from the covering wall on a side opposite to the first facing surface.

* * * * *